US005313867A

United States Patent [19]

Terada et al.

[11] Patent Number: 5,313,867

[45] Date of Patent: May 24, 1994

[54] GLOCKENSPIEL EQUIPPED WITH HAMMER HEADS DIFFERENT IN HARDNESS FOR CHANGING TONE COLOR

[75] Inventors: Norishige Terada; Shinsuke Irisa, both of Shizuoka, Japan

[73] Assignee: Yamaha Corporation, Hamamatsu, Japan

[21] Appl. No.: 981,179

[22] Filed: Nov. 24, 1992

[51] Int. Cl.[5] ..... G10D 13/08

[52] U.S. Cl. ..... 84/404

[58] Field of Search ..... 84/254, 404, 447, 422.1, 84/422.4

[56] References Cited

U.S. PATENT DOCUMENTS 1,392,248 9/1921 Cloetens ..... 84/422.1

2,586,163 7/1947 Heiderich et al. ..... 84/422.1

*Primary Examiner*—Michael L. Gellner

*Assistant Examiner*—P. Stanzione

*Attorney, Agent, or Firm*—Spensley Horn Jubas & Lubitz

[57] ABSTRACT

A glockenspiel comprises a keyboard implemented by a plurality of keys respectively associated with tuned sound bars, and each of the tuned sound bars is struck by a hammer upon depressing the associated key, wherein a plurality of hammer heads different in hardness are embedded into a hammer body and selectively brought into abutting engagement with the associated tuned sound bar so that tone color is changed during performance of a music.

11 Claims, 6 Drawing Sheets

GLOCKENSPIEL EQUIPPED WITH HAMMER HEADS DIFFERENT IN HARDNESS FOR CHANGING TONE COLOR

FIELD OF THE INVENTION

This invention relates to a glockenspiel and, more particularly, to tuned bars struck with associated hammers driven by a keyboard.

DESCRIPTION OF THE RELATED ART

A key action mechanism is incorporated in the glockenspiel accompanied with the keyboard, and comprises a plurality of hammers respectively assigned to tuned bars, and a plurality of springs for producing elastic forces exerted on the associated hammers upon depressing keys on the keyboard. However, any damper mechanism is not incorporated in the key action mechanism. When a key is depressed, the elastic force is exerted on the associated hammer, and, accordingly, the associated hammer is driven for rotation toward a struck surface of the associated tuned bar. The tuned bars are respectively accompanied with resonant tubes, and the resonant tubes are provided on the reverse surfaces of the tuned bars. The resonant tubes are of a closed tube, and are designed in such a manner as to resonate with harmonic overtones of the fundamental tones inherent in the associated tuned bars. This feature, resonance with the harmonic overtones is desirable for the resonant tubes, because the resonant tubes are shrunk.

However, a problem is encountered in the prior art glockenspiel in that tone color is unchangeable through a performance, and the uniform tone color limits the musical presentation. This is because of the fact that all of the hammers are formed of brass.

Another problem inherent in the prior art glockenspiel is irregular termination of sounds, and a plurality of tones are undesirably mixed in a swift melody. As a result, the prior art glockenspiel is only available for slow melodies, and limit is set on selection of music.

Third problem relates to the resonant tubes. Although the resonant tubes for the harmonic overtones are relatively short, the total amount of space occupied by the tubes are not ignorable, and, accordingly, the prior art glockenspiel is large in size.

The final problem also relates to the resonant tubes, and is encountered in that the resonance is poor for bass sounds.

SUMMARY OF THE INVENTION

It is therefore an important object of the present invention to provide a glockenspiel the tone color of which is changeable.

To accomplish the object, the present invention proposes to provide hammer heads different in hardness on the surface of each hammer body shiftable with respect to an associated tuned sound bar.

In accordance with the present invention, there is provided a glockenspiel comprising: a) a keyboard implemented by a plurality of keys; b) a tuned sound bar array implemented by a plurality of tuned sound bars respectively associated with the plurality of keys; c) a key action mechanism having a plurality of key action sub-mechanisms respectively linked with the plurality of keys; d) a hammer mechanism having a plurality of hammer sub-mechanisms respectively linked with the plurality of key action sub-mechanisms for striking the plurality of tuned sound bars when the keys are selectively depressed, each of the plurality of hammer sub-mechanisms comprising a hammer body, and a plurality of hammer heads different in hardness and provided on a surface of the hammer body for selectively brought into abutting engagement with the associated tuned sound bar when the associated key is depressed; and e) a shifting mechanism driven by a player and operative to change relatively relation between the hammer body and the associated tuned sound bar so as to allow the plurality of hammer heads to be selectively brought into abutting engagement with the associated tuned sound bar.

BRIEF DESCRIPTION OF THE DRAWINGS

The features and advantages of the glockenspiel according to the present invention will be more clearly understood from the following description taken in conjunction with the accompanying drawings in which.

DESCRIPTION OF THE PREFERRED EMBODIMENTS

First Embodiment

Figure 1:
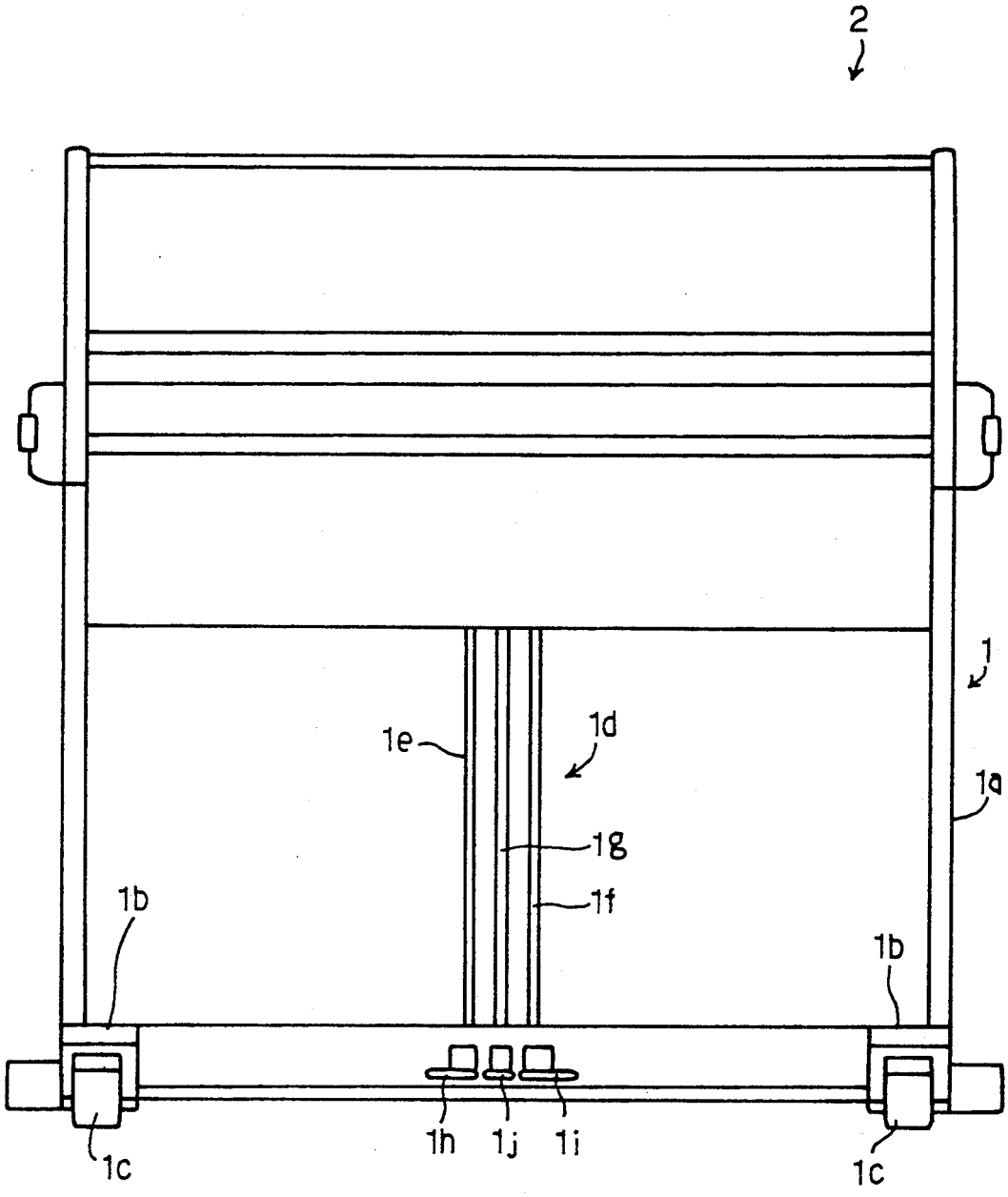
FIG. 1 is a front view showing a glockenspiel according to the present invention.
Figure 2:
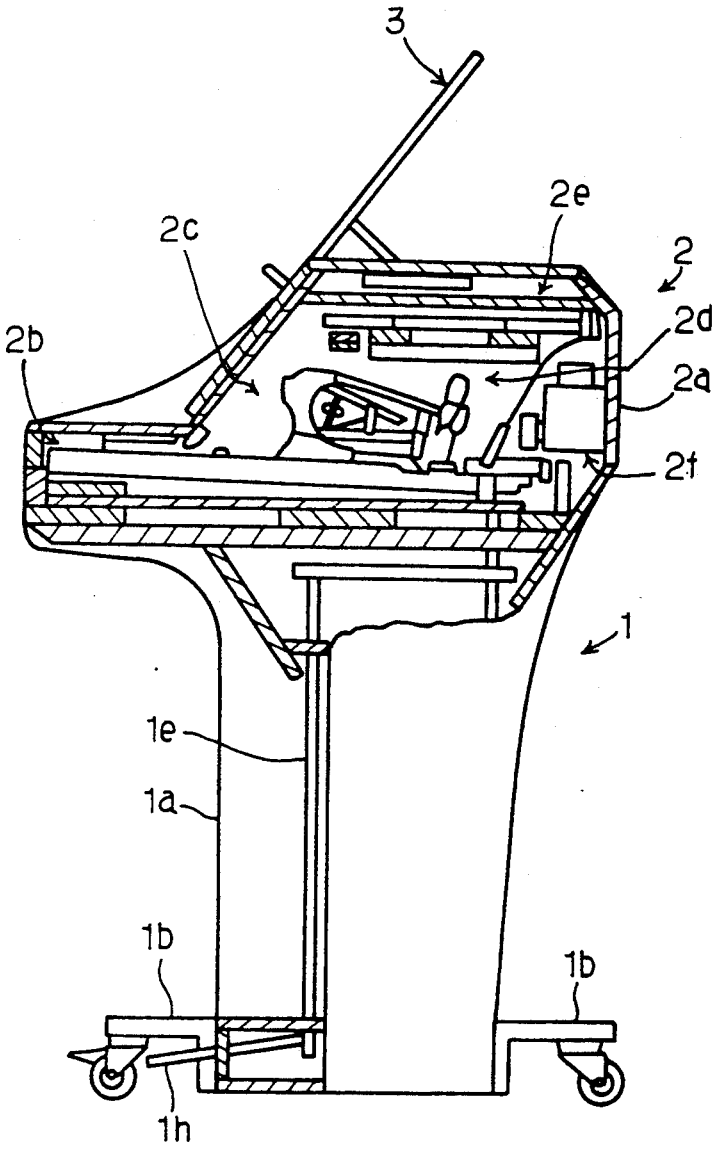
FIG. 2 is a partially cut-away side view showing the structure of the glockenspiel.

Referring first to FIGS. 1 and 2 of the drawings, a glockenspiel embodying the present invention largely comprises a supporting structure 1, a glockenspiel unit 2 detachable from the supporting structure 1, and a retractable music rack assembly 3. The reason why the glockenspiel unit 2 is detachable from the supporting structure 1 is enhancement of portability.

The supporting structure 1 comprises a housing member 1*a*, four legs 1*b* projecting from the housing 1*a*, and four casters 1*c* rotatably supported by the four legs 1*b*, respectively, and a pedal mechanism 1*d* forming parts of the glockenspiel unit 2 are supported by the housing 1*a*. The pedal mechanism 1*d* comprises a shifting sub-mechanism 1*e*, a damper sub-mechanism 1*f* and a muting sub-mechanism 1*g* which are respectively coupled with a shift pedal 1*h*, a damper pedal 1*i* and a muting pedal 1*j*. The shifting sub-mechanism 1*e* and the damper mechanism 1*i* are similar to a soft pedal mechanism and a damper pedal mechanism incorporated in a grand piano in view of motion, and the damper pedal 1*i* allows sounds to continue when being depressed. However, the damper sub-mechanism 1*f* will be hereinlater described again. When these pedals 1*h* to 1*j* are selectively depressed by a player, the associated sub-mechanisms 1*e* to 1*g* are driven for activation, and behave as described hereinbelow.

Figure 3:
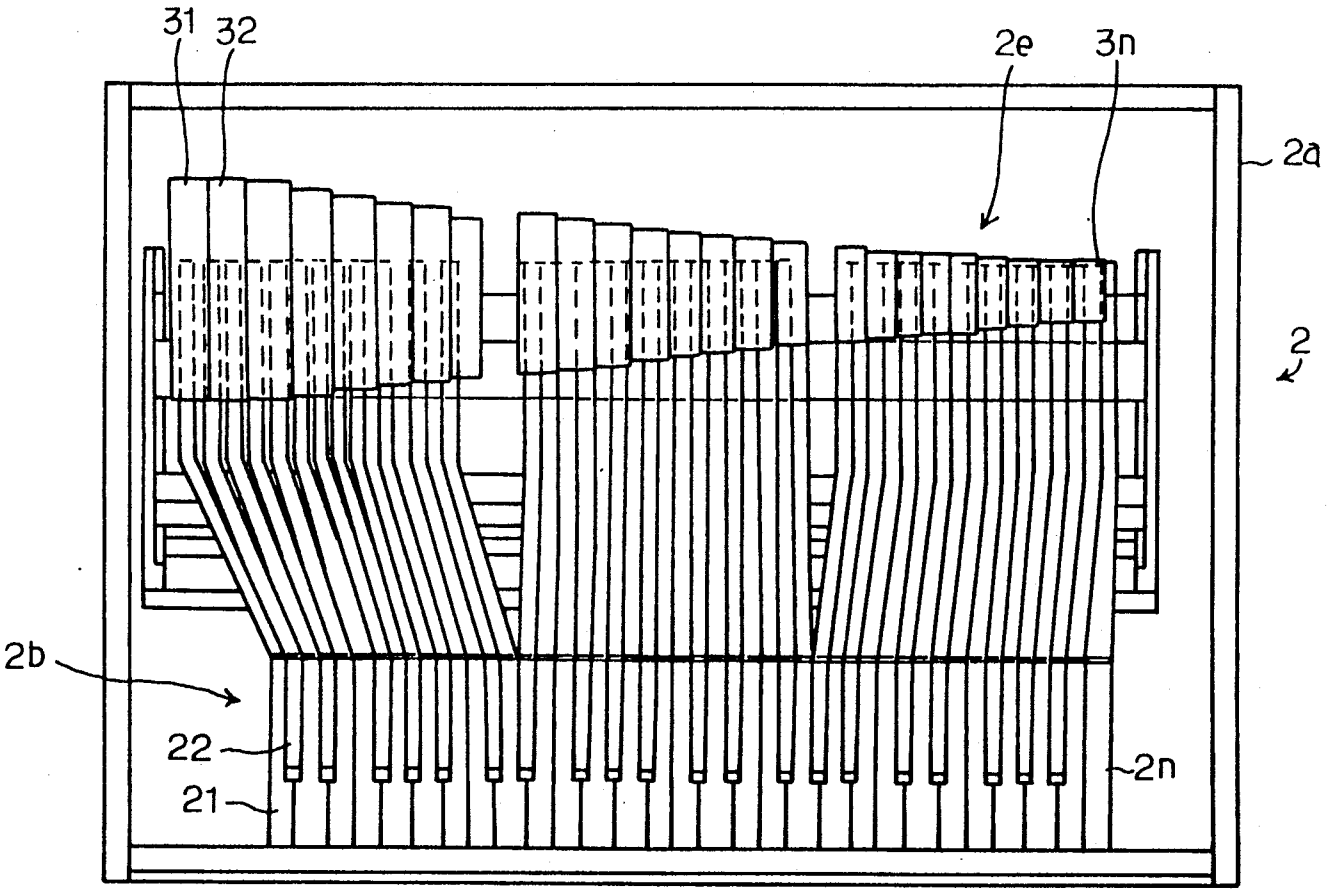
FIG. 3 is a plan view showing the arrangement of a keyboard associated with a tuned sound bar array incorporated in the glockenspiel.

The glockenspiel unit 2 comprises a case 2*a*, a keyboard 2*b* mounted on the case 2*a*, a key action mechanism 2*c* associated with the keyboard 2*b*, a hammer mechanism 2*d* driven by the key action mechanism 2*c*, a tuned sound bar array 2*e* supported by the case 2*a* and struck with the hammer mechanism 2*d* for producing sounds, and a resonator array 2*f* associated with the tuned sound bar array 2*e*, and the key action mechanism 2*c*, the hammer mechanism 2*d*, the tuned sound bar array 2*e* and the resonator array 2*f* are housed in the case 2*a*. As will be better seen from FIG. 3, the keyboard 2*b* is implemented by a plurality of keys 21, 22, . . . and 2*n*, and the plurality of keys 21 to 2*n* are respectively associated with a plurality of tuned sound bars 31, 32, . . . and 3*n*. In this instance, forty nine tuned sound bars 31 to 3*i* are incorporated in the tuned sound bar array 2*e*, and are formed of metal such as, for example, copper or aluminum. Most of the tuned sound bars 31 to 3*n* are equal in diameter to one another, and are different in length. However, some tuned sound bars assigned the lowest pitch tones are equal in length to one another, and are larger in diameter than the other tuned sound bars. This feature is attractive, because the tuned sound bar array 2*e* is small in size. In another example, weights may be provided for the tuned sound bars assigned the lowest pitch tones, and these tuned sound bars become shorter. Each of the keys 21 to 2*n* is linked with a key action sub-mechanisms 41, and the key action sub-mechanism 41 drives an associated hammer sub-mechanism 51 for striking the associated tuned sound bar. Since all of the action lines from the keys 21 to 2*n* to the tuned sound bars 31 to 3*n* are similar to one another, and description is made on one of the keys 2*i* associated with a tuned sound bar 3*i* only for avoiding repetition.

Figure 4:
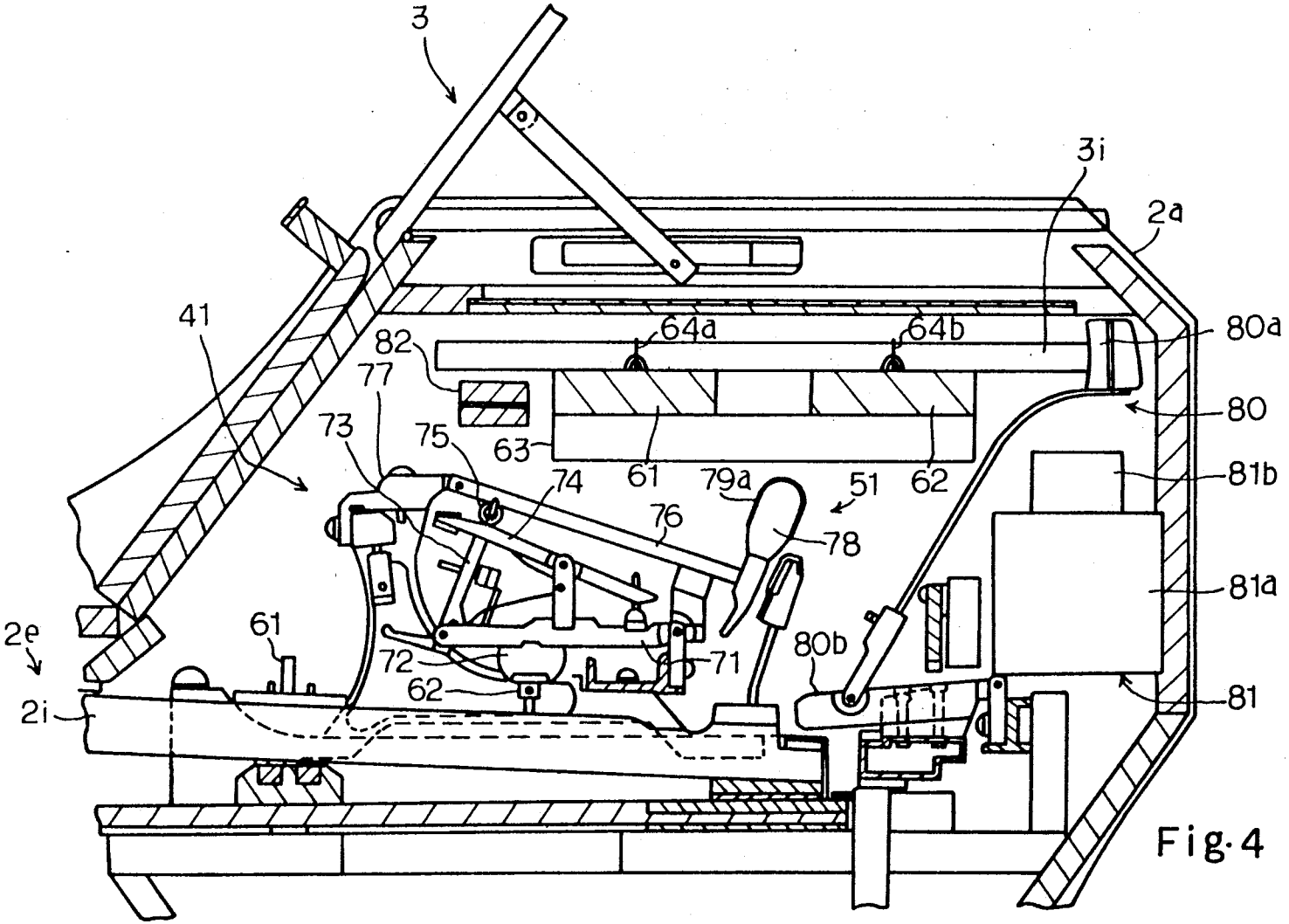
FIG. 4 is a partially cut-away side view showing the glockenspiel unit incorporated in the glockenspiel according to the present invention.

Turning to FIG. 4 of the drawings, the key 2*i*, the key action sub-mechanism 41 and the hammer sub-mechanism 51 are sequentially linked so as to form the action line, and the tuned sound bar 3*i* is mounted on juxtaposed supporting beams 61 and 62. The supporting beams 61 and 62 are terminated at the case 2*a*, and fixed thereto by means of brackets 63. Strings 64*a* and 64*b* are wound on the tuned sound bar 3*i*, and are anchored at the supporting beams 61 and 62 by means of U-shaped anchor pins 65*a* and 65*b*, respectively. As will be better seen from FIG. 5 of the drawings, the strings 64*a* and 64*b* are further wound on the U-shaped anchor pins 65*a* and 65*b*, and are tied thereto. For this reason, the tuned sound bar 3*i* is fixed to the supporting beams 61 and 62, and the strings 64*a* and 64*b* are inserted between the tuned sound bar 3*i* and the supporting beams 61 and 62. The strings 64*a* and 64*b* are wound on the tuned sound bar 3*i* at predetermined points, and the predetermined points are aligned with noses of vibrations produced therein. In this instance, the predetermined points are located at 22.4 percent of the total length of the tuned sound bar 3*i* when measuring from both sides thereof.

Turning back to FIG. 4 of the drawings, the key 2*i* is rockable with respect to a balance pin 61, and capstan screws 62 upwardly projects therefrom. The key action sub-mechanism 41 is mounted on the key 2*i*, and is similar in structure to that incorporated in a grand piano. The key action sub-mechanism 41 comprises a whippen 71 accompanied with a whippen heel 21, and the whippen heel 72 is held in contact with the capstan screw 62. A jack 73 is swingablly supported by the whippen 71, and the jack 73 is coupled with a repetition lever 74. The repetition lever 74 is coupled with the associated hammer sub-mechanism 51. Namely, a hammer roller 75 attached to a hammer shank 76 is rolling contact with the repetition lever 74, and the hammer shank 76 is swingablly supported by a hammer shank flange 77. A hammer 78 of ABS resin is attached with the leading end of the hammer shank 76, and hammer heads 79*a*, 79*b*, 79*c* and 79*d* are embedded into the hammer 78. Thus, the key action sub-mechanism 41 and the hammer sub-mechanism 51 are similar to those incorporated in a grand piano, and, accordingly, behave as similar thereto. Namely, when the key 2*i* is depressed, the capstan screw 62 lifts the whippen 72, and the jack 73 pushes the repetition lever 76 and, accordingly, the hammer shank 76. Then, the hammer 78 is driven for rotation in the counter-clock direction, and the tuned sound bar 3*i* is struck with any one of the hammer heads 79*a* to 79*d* as described hereinbelow.

Figure 5:
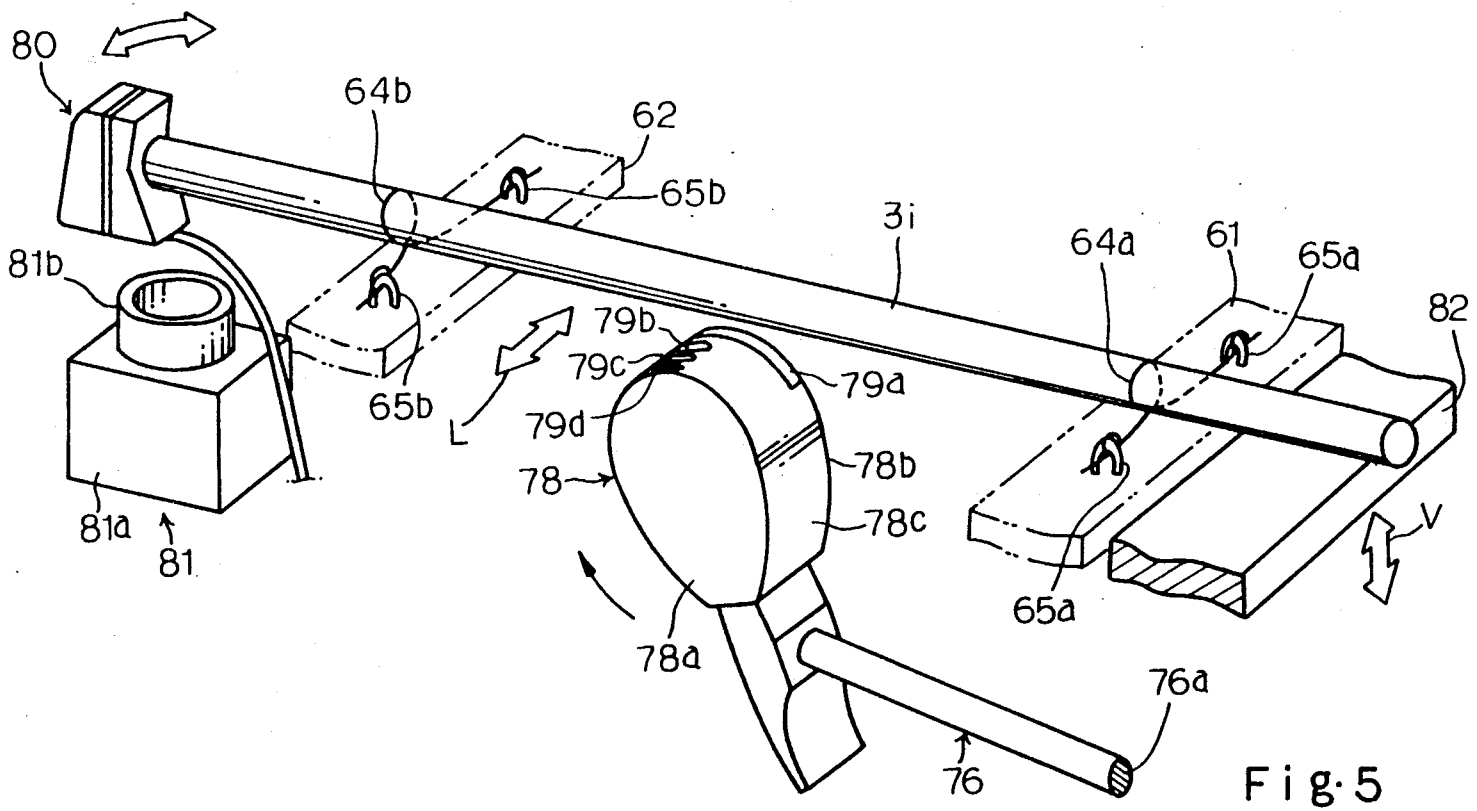
FIG. 5 is a perspective view showing a tuned sound bar tied to supporting beams incorporated in the glockenspiel unit.

As will be better seen from FIG. 5 of the drawings, the hammer 78 has generally elliptic side surfaces 78*a* and 78*b* and a peripheral surface 78*c* extending along the peripheries of the generally elliptic side surfaces 78*a* and 78*b*, and the hammer heads 79*a* to 79*d* are arranged in the direction of width. The hammer shank 76 has a elliptic cross section 76*a*, and the major axis of the elliptic cross section is substantially in parallel to the direction of the width of the hammer 78, and, accordingly, force produced upon the striking is exerted on the hammer shank 76 in the direction of the minor axis of the elliptic cross section. For this reason, the hammer shank 76 is elastically deformed rather than a hammer shank incorporated in a grand piano. As a result, the selected hammer head rapidly rebounds on the associated tuned sound bar 3*i*, and, accordingly, does not prevent the tuned sound bar from free vibrations. In this instance, the hammer heads 79*a* to 79*d* are formed of synthetic leather, rubber, aluminum and brass, respectively, and, for this reason, the substances of the hammer heads 79*a* to 79*d* are different in hardness. The shifting sub-mechanism 1*e* is linked with the hammer sub-mechanisms, and causes the hammer sub-mechanisms to laterally move in the direction of width of the hammer 78 as indicated by arrow L. Namely, the shift pedal 1*h* is linked through a pedal rod with a shift lever, and the shift lever in turn is coupled through a balance rail with the keyboard 2*b* and, accordingly, the hammer mechanism 2*d*. As a result, when the shift pedal 1*h* is depressed, the pedal rod is upwardly moved, and the pedal rod causes the shift lever to swing, thereby allowing the keyboard 2*b* and the hammer mechanism 2*d* to laterally moved as indicated by the arrow L. The amount of the lateral movement of the hammer 78 is proportional to the distance over which the shift pedal 1*h* is depressed. For this reason, when the player depresses a key, any one of the hammer heads 79*a* to 79*d* strikes the associated tuned sound bar, and the tone color is variable by using the shift pedal 1*h*.

As described hereinbefore, the damper sub-mechanism 1*f* allows the sounds to continue when the damper pedal 1*i* is depressed. However, the damper sub-mechanism 1*f* is further driven by the plurality of keys 21 to 2*n*. Namely, the damper sub-mechanism further comprises a plurality of damper units respectively associated with the keys 21 to 2*n* and the tuned sound bars 31 to 3*n*, and one of the damper units is illustrated in FIG. 4 and labeled with reference numeral 80. The damper unit 80 has a damper felt 80*a*, and the damper felt 80*a* is held in contact with the associated tuned sound bar 3*i* while the key 2*i* is released. When the key 2*i* is depressed, the key 2*i* kicks a lever 80*b*, and the damper felt 80*a* is driven for rotation in the clockwise direction, thereby leaving from the associated tuned sound bar 3*i*. However, when the player released the key 2*i*, the damper felt 80*a* returns to the initial position, and is held in contact with the associated tuned sound bar 3*i* again. However, if the damper pedal 1*i* is depressed, the damper felts 80*a* of all the damper units are left from the associated tuned sound bars 31 to 3*i*, and the tuned sound bars vibrate without any damping. Thus, the damper unit 80 is operative to damp the vibrations produced in the associated tuned sound bar 3*i*, and the sound terminates at predetermined timing. For this reason, the glockenspiel according to the present invention is responsive to a swift melody, and is available for a wide variety of music.

As described hereinbefore, the tuned sound bars assigned the lowest one octave are accompanied with a resonator array 2*f*, and one of the resonators is shown in FIG. 4 and labeled with reference numeral 81. The resonators are of the Helmholtz type, and each of the resonators such as 81 comprise a box 81*a* of predetermined volume and an inlet nozzle 81*b* open toward predetermined area of the associated tuned sound bar 3*i*. The Helmholtz type resonator emphasizes fundamental tones of the bass sounds, and the bass sounds are exactly on a selected scale. The resonator 81 is close to the associated tuned sound bar 3*i*, and the predetermined area is spaced apart from the rear end surface of the associated tuned sound bar 3*i*. While a music is played by using the glockenspiel according to the present invention, the case 2*a* per se resonates the sounds produced in the tuned sound bars, and the sounds of the lowest octave are further resonated by the Helmholtz type resonators. The Helmholtz type resonator is desirable for the glockenspiel, because the Helmholtz type resonator is smaller in size than the prior art closed tube type resonator. Moreover, the tuned sound bars assigned the lowest one octave are further resonated with the Helmholtz type resonators, and the glockenspiel according to the present invention makes the bass sounds rich.

The muting sub-mechanism 1*g* makes sounds week. The muting sub-mechanism has a muting damper 82, and the muting damper 82 is lifted by the muting pedal 1*j* as indicated by an arrow V as shown in FIG. 5. The amount of the upward movement of the muting damper 82 is proportional to distance over which the muting pedal 1*j* is depressed. For this reason, the muting damper 82 is pressed against the tuned sound bars 31 to 3*n* with force proportional to the distance of the muting pedal 1*j*, and makes the sound week.

The damper felts 80*a* and the muting damper 82 are brought into contact with the tuned sound bars 31 to 3*n* outside the supporting beams 61 and 62, and the hammer heads strike the associated tuned sound bars at inner positions with respect to the supporting beams 61 and 62. The contact points of the damper felts 80*a* and the muting damper 82 are aligned with anti-nodes of vibrations produced in the tuned sound bars 31 to 3*n*, and the tuned sound bars 31 to 3*n* are supported by the supporting beams 61 and 62 at the predetermined points aligned with the nodes of the vibrations. Therefore, the relations between the hammer heads 69*a* to 69*d*, the tuned sound bars 31 to 3*n*, the supporting beams 61 and 62 and the dampers 80 and 82 are desirable for vibrations as well as for the damping.

The music rack assembly 3 is retractable as described hereinbefore. While the music rack assembly 3 is retracted, the music rack assembly 3 forms a part of the upper board of the case 2*a*. The music rack assembly 3 is adjustable to any one of five angular positions, and serves as a reflecting board. While the player performs the glockenspiel according to the present invention, the player takes directivity and loudness of sounds into account of, and the music rack assembly 3 is adjusted to one of the angular positions.

Second Embodiment

Figure 6:
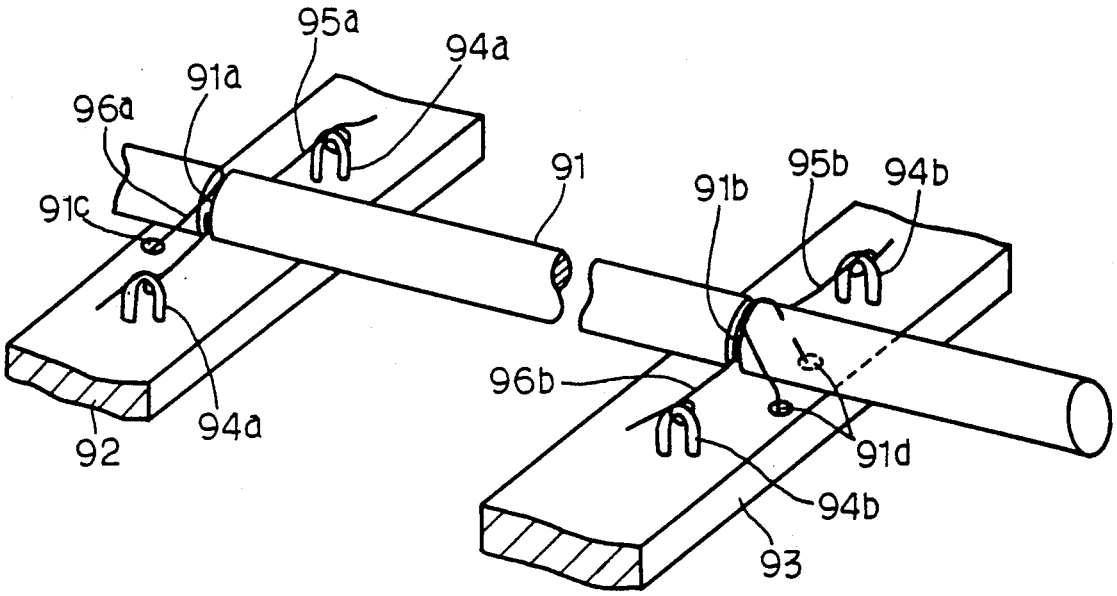
FIG. 6 is a perspective view showing a tuned sound bar and supporting beams incorporated in another glockenspiel according to the present invention.

Turning to FIG. 6 of the drawings, a tuned sound bar 91 incorporated in another glockenspiel embodying the present invention is mounted on supporting beams 92 and 93. However, the other components are similar to those of the first embodiment, and no further description is incorporated hereinbelow for avoiding repetition. Two grooves 91*a* and 91*b* are formed in the tuned sound bar 91 at predetermined points aligned with nodes of vibrations produced therein. In this instance, the predetermined points are also located at 22.4 percent of the length of the tuned sound bar 91 measured from both ends thereof.

U-shaped anchor pins 94*a* and 94*b* are fixed to the tuned sound bar 91, and the tuned sound bar 91 passes through between the anchor pins 94*a* and 94*b*. Strings 95*a* and 95*b* are stretched between the anchor pins 94*a* and 94*b*, and are tied thereto. The tuned sound bar 91 is placed on the strings 95*a* and 95*b* in such a manner that the strings 95*a* and 95*b* passes through the grooves 91*a* and 91*b*, and the strings 95*a* and 95*b* allows the tuned sound bar 91 to float on the strings 95*a* and 95*b*.

Through holes 91*c* and 91*d* are further formed in the supporting beams 92 and 93, and flexible strings 96*a* and 96*b* of, for example, rubber are anchored at the reverse surfaces of the supporting beams 92 and 93. Namely, each of the flexible strings 96*a* and 96*b* passes through the through holes 91*c* or 91*d*, and knots 97 larger in diameter than the through holes 91*c* or 91*d* do not allow the string 96*a* or 96*b* to pass the through holes 91*c* or 91*d*.

Figure 7:
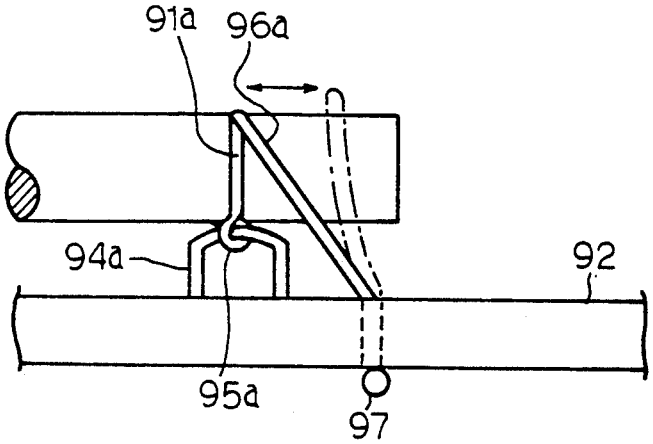
FIG. 7 is a side view showing a flexible string wound on the tuned sound bar.

While assembling, the flexible strings 96*a* and 96*b* are engaged with the tuned sound bar 91 outside the grooves 91*a* and 91*b* as indicated by dot-and-dash lines in FIG. 7, and the flexible strings 96*a* and 96*b* are moved into the grooves 91*a* and 91*b* so that the flexible strings urge the tuned sound bar 91 toward both ends thereof. As a result, the tuned sound bar 91 is stationary on the strings 95*a* and 95*b*. When disassembled, the flexible strings 96*a* and 96*b* return to the positions indicated by the dot-and-dash lines, and the tuned sound bar 91 is easily left from the supporting beams 92 and 93.

Thus, the tuned sound bar 91 floats on the strings 95*a* and 95*b*, and the strings 95*a* and 95*b* allows the tuned sound bar 91 to freely vibrate.

Although particular embodiments of the present invention have been shown and described, it will be obvious to those skilled in the art that various changes and modifications may be made without departing from the spirit and scope of the present invention. For example, the Helmholtz type resonators may be respectively provided for all of the tuned sound bars, and a resonator may be shared between a plurality of tuned sound bars. Moreover, the resonators may be of a closed tube type. The tuned sound bars of the embodiments are circle in cross section. However, a tuned sound bar of another embodiment may have a partially rectangular and partially semi-circular cross section. Each of the damper units may be brought into contact with the opposite end surface of the associated tuned sound bar. The tuned sound bars may be mounted on felt sheets instead of the strings.

What is claimed is:

1. A glockenspiel comprising:

a) a keyboard implemented by a plurality of keys;

b) a tuned sound bar array implemented by a plurality of tuned sound bars respectively associated with said plurality of keys;

c) a key action mechanism having a plurality of key action sub-mechanisms respectively linked with said plurality of keys;

d) a hammer mechanism having a plurality of hammer sub-mechanisms respectively linked with said plurality of key action sub-mechanisms for striking said plurality of tuned sound bars when said keys are selectively depressed, each of said plurality of hammer sub-mechanisms comprising a hammer body, and a plurality of hammer heads different in hardness and provided on a surface of said hammer body for selectively being brought into abutting engagement with the associated tuned sound bar when the associated key is depressed; and e) a shifting mechanism driven by a player and operative to change relatively relation between said hammer body and said associated tuned sound bar so as to allow said plurality of hammer heads to be selectively brought into abutting engagement with said associated tuned sound bar.

2. A glockenspiel as set forth in claim 1, in which said keyboard, said tuned sound bar array, said key action mechanism and said hammer mechanism form parts of a glockenspiel unit detachably mounted on a supporting structure.

3. A glockenspiel as set forth in claim 1, in which further comprising a pedal mechanism having a damper sub-mechanism associated with said plurality of tuned sound bars and operative to damp vibrations produced in the tuned sound bars.

4. A glockenspiel as set forth in claim 3, in which said pedal mechanism further comprises a muting sub-mechanism brought into abutting engagement with said plurality of tuned sound bars when a player operates for muting sounds selectively produced in said plurality of tuned sound bars.

5. A glockenspiel as set forth in claim 1, in which further comprising a Helmholtz resonator means associated with said tuned sound bar array.

6. A glockenspiel as set forth in claim 1, in which said plurality of tuned sound bars are mounted on supporting beams fixed to a case accommodating said tuned sound bar array, said key action mechanism and said hammer mechanism, and are located over said hammer sub-mechanisms, respectively.

7. A glockenspiel as set forth in claim 6, in which each of said plurality of tuned sound bars is fixed to said supporting beams by means of strings at predetermined points aligned with nodes of vibrations produced in the each of said plurality of tuned sound bars.

8. A glockenspiel as set forth in claim 7, in which said predetermined points are located at 22.4 percent of the length of each tuned sound bar measured from both ends thereof.

9. A glockenspiel as set forth in claim 1, in which further comprising a retractable music rack assembly.

10. A glockenspiel as set forth in claim 1, in which each of said plurality of hammer sub-mechanism comprises a hammer shank flange, a hammer shank swingablly supported by said hammer shank flange and having an elliptic cross section, and said hammer body coupled with the leading end portion of said hammer shank, said hammer shank being arranged in such a manner that force produced upon striking the associated tuned sound bar is exerted on said hammer shank in a direction parallel to the minor axis of said elliptic cross section.

11. A glockenspiel comprising:

a) a supporting structure;

b) a glockenspiel unit detachably mounted on said supporting structure, and including b-1) a keyboard implemented by a plurality of keys, b-2) a tuned sound bar array implemented by a plurality of tuned sound bars respectively associated with said plurality of keys and mounted on supporting beams fixed to a case of said glockenspiel unit, strings anchored at said supporting beams being wound on each of said tuned sound bars at predetermined points, said predetermined points being located at 22.4 percent of the length of each tuned sound bar measured from both ends thereof, b-3) a key action mechanism having a plurality of key action sub-mechanisms respectively linked with said plurality of keys, b-4) a hammer mechanism having a plurality of hammer sub-mechanisms respectively linked with said plurality of key action sub-mechanisms for striking said plurality of tuned sound bars located thereover when said keys are selectively depressed, each of said plurality of hammer sub-mechanisms comprising a hammer body, and a plurality of hammer heads respectively formed of synthetic leather, rubber, aluminum and brass and provided on a surface of said hammer body for selectively being brought into abutting engagement with the associated tuned sound bar when the associated key is depressed, b-5) a shifting mechanism driven by a player and operative to change relatively relation between said hammer body and said associated tuned sound bar so as to allow said plurality of hammer heads to be brought into abutting engagement with said associated tuned sound bar, b-6) a pedal mechanism having a damper sub-mechanism associated with said plurality of tuned sound bars and operative to damp vibrations produced in the associated tuned sound bar, and a muting sub-mechanism brought into abutting engagement on said plurality of tuned sound bars when a player operates for muting sounds selectively produced in said plurality of tuned sound bars, and b-7) a Helmholtz resonator means associated with said tuned sound bar array; and c) a music rack assembly retractable with respect to said glockenspiel unit.

* * * * *